US007653967B2

(12) United States Patent
Lowe et al.

(10) Patent No.: US 7,653,967 B2
(45) Date of Patent: Feb. 2, 2010

(54) COMPACT ADJUSTABLE HINGE

(75) Inventors: Mark Jeffrey Lowe, Bossier City, LA (US); Udhaya Bhaskar Nallamottu, Shreveport, LA (US)

(73) Assignee: Hardware Resources, Inc., Bossier City, LA (US)

( * ) Notice: Subject to any disclaimer, the term of this patent is extended or adjusted under 35 U.S.C. 154(b) by 35 days.

(21) Appl. No.: 11/800,452

(22) Filed: May 4, 2007

(65) Prior Publication Data

US 2008/0271292 A1 Nov. 6, 2008

(51) Int. Cl.
*E05D 7/04* (2006.01)

(52) U.S. Cl. ..... 16/238; 16/245

(58) Field of Classification Search ..... 16/238, 16/236, 237, 240, 245, 246
See application file for complete search history.

(56) References Cited

U.S. PATENT DOCUMENTS

| | | | | |
|---|---|---|---|---|
| 3,863,292 | A | 2/1975 | Grunert et al. | |
| 4,506,409 | A | 3/1985 | Lautenschlager | |
| 5,175,908 | A | 1/1993 | Domenig | |
| 5,353,476 | A | 10/1994 | Domenig | |
| 5,392,493 | A | 2/1995 | Youngdale | |
| 5,414,896 | A | 5/1995 | Domenig | |
| RE34,995 | E | 7/1995 | Domenig | |
| 5,485,656 | A | 1/1996 | Domenig | |
| 5,604,956 | A | 2/1997 | Grass | |
| 5,617,612 | A | 4/1997 | Ferrari et al. | |
| 5,781,967 | A | 7/1998 | Domenig | |
| 5,826,305 | A | 10/1998 | Domenig et al. | |
| 5,884,364 | A | 3/1999 | Domenig et al. | |
| 5,920,958 | A | 7/1999 | Domenig et al. | |
| 6,167,590 | B1 | 1/2001 | Domenig | |
| 6,249,934 | B1 | 6/2001 | Moser | |
| 6,470,531 | B2 | 10/2002 | Domenig et al. | |
| D477,982 | S | 8/2003 | Domenig et al. | |
| 6,642,895 | B2 | 11/2003 | Zurcher et al. | |
| 6,643,895 | B1 | 11/2003 | Domenig et al. | |
| 6,647,591 | B1 | 11/2003 | Domenig et al. | |
| 6,694,567 | B1 | 2/2004 | Domenig et al. | |
| 6,698,062 | B2 | 3/2004 | Egger et al. | |
| 6,810,563 | B1 | 11/2004 | Domenig et al. | |
| 6,845,544 | B2 * | 1/2005 | Hofer | 16/246 |
| 6,880,205 | B2 * | 4/2005 | Rupprechter | 16/235 |
| 6,918,158 | B2 * | 7/2005 | Isele | 16/235 |
| 6,996,877 | B2 | 2/2006 | Booker et al. | |
| D523,323 | S | 6/2006 | Domenig et al. | |
| 7,117,561 | B1 | 10/2006 | Domenig et al. | |
| 7,591,044 | B2 * | 9/2009 | Migli | 16/235 |
| 2007/0136988 | A1 * | 6/2007 | Bullock | 16/245 |

* cited by examiner

*Primary Examiner*—Victor Batson
*Assistant Examiner*—Rowland D Do
(74) *Attorney, Agent, or Firm*—Schultz & Associates, P.C.

(57) ABSTRACT

The invention disclosed provides a compact hinge capable of a vertical, a horizontal, and an overlay adjustment, comprised of a cup portion and a hinge arm with one end pivotably connected to the cup portion and the other end slideably connected to a fastener plate. The fastener plate further comprises a first semi-planar surface for contact with a cabinet frame and a second semi-planar surface for slideable engagement with the hinge arm to accomplish the horizontal adjustment. The first and second semi-planar surfaces are interconnected by a deformable hinge section that allows for an elastically resilient connection at one end and an adjusting screw at the other end for a horizontally arcing movement relative to each resulting in an overlay adjustment. The fastener plate further comprises an elongated aperture in the first semi-planar surface through which the vertical adjustment is accomplished.

16 Claims, 6 Drawing Sheets

COMPACT ADJUSTABLE HINGE

FIELD OF THE INVENTION

The present invention relates to a compact hinge for furniture products. In particular, the present invention relates to a compact overlay hinge that is capable of adjustment in three dimensions.

BACKGROUND OF THE INVENTION

Cabinet doors for cabinets generally must be individually adjusted to compensate for manufacturing tolerances. Adjustment is usually required in more than one dimension. If the door has two or more hinges, as is usually the case, adjustments must be carried out on each hinge with respect to the other hinges. A "vertical adjustment" is required when the door does not seat properly with respect to the top and bottom of the cabinet frame. An "overlay adjustment" is a lateral or "side to side" adjustment required when the door does not properly align with the sides of the cabinet frame. A horizontal or an "in and out" adjustment required when the door does not lay flush with the cabinet frame.

Prior art hinges suffer from various disadvantages including difficulty in installation, insufficient adjustment capabilities, instability of the adjustments made, complicated construction, and high manufacturing costs.

U.S. Pat. No. 6,647,591 to Domenig et al. discloses a low profile, partial door overlay hinge having a hinge cup, an intermediate base hinge and top hinge arm segments. In order to accomplish adjustments in three dimensions, this device requires a complicated assembly necessitating several assembly connection points. Further, multiple cam screws or eccentric cam screws are required to effectuate the adjustments. All of the above increases the manufacturing complexity and cost of the device.

U.S. Pat. No. 6,694,567 to Domenig et al. discloses an overlay hinge having a hinge cup, a base hinge arm segment and an L-shaped hinge arm segment. This device requires multiple plate hinge arm segments to achieve the three-dimensional adjustment capability. The device of the '567 patent also requires multiple intricate and expensive pieces requiring complex assembly steps and hardware to function as an adjustable hinge.

U.S. Pat. No. 5,920,958 to Domenig, et al. discloses an adjustable furniture hinge having a hinge cup, a hinge arm and a hinge plate. The hinge arm is pivotally connected to both the hinge cup and the hinge plate. The number of hinge arm segments is lessened, but the intricate parts and the complex assembly remains while the hinge only accommodates a vertical adjustment and a horizontal overlay adjustment.

U.S. Pat. No. Re. 34,995 to Domenig discloses an adjustable recessed door hinge having a hinge cup in a bore in a door member and a hinge arm securable to a cabinet member. The hinge cup has two slotted holes for receiving attachment screws that guide displacement of the hinge cup for a side-to-side adjustment. The invention of the '995 patent requires the adjustment of at least two mounting screws per hinge used to mount the hinge cup in order to effectuate a horizontal overlay adjustment. After repeated adjustment as is required to secure and adjust a door, the fit of newly inserted screws becomes unstable which ultimately results in an insecure mounting of the door on the cabinet.

SUMMARY OF THE INVENTION

The present invention addresses the need for a simply designed and adjustable self closing compact hinge, particularly one including the capability of adjustments in three dimensions with a minimum number of components that can be easily and economically manufactured and installed.

Accordingly, an embodiment of the present invention provides an adjustable self closing compact hinge that includes a cup for mounting in a door and a hinge arm assembly pivotably connected to the cup by means of a hinge pin. The hinge arm assembly includes a hinge arm that is slideably coupled to a fastener plate. The fastener plate is attachable to the frame of a cabinet by a mounting screw through an elongated hole oriented vertically in the fastener plate. The elongated hole in the fastener plate facilitates a vertical adjustment parallel to the axis of the hinge pin. The fastener plate and the hinge arm are slidably engaged to each other and through an eccentric cam can accommodate a horizontal adjustment perpendicular to the axis of the hinge pin. The fastener plate includes a first planar surface for contact with the frame of a cabinet and a second planar surface for engagement with the hinge arm. The first planar surface and the second planar surface of the fastener plate are interconnected by a semi-cylindrical elastically flexible hinge section that allows the distance between the first planar surface and the second planar surface to be selectively adjusted by an adjustment screw which facilitates a lateral adjustment.

A benefit of the present invention includes the requirement of fewer component parts to obtain the three dimensional adjustment functionality, specifically; there is no independent intermediate structure between the hinge arm and the component part that becomes attached to the cabinet frame as in the prior art. Additionally, there is no hinge pin needed to couple the hinge arm and any various mounting plates or intermediate plates.

Those skilled in the art will appreciate the above-mentioned features and advantages of the invention together with other important aspects upon reading the detailed description that follows in conjunction with the drawings.

DETAILED DESCRIPTION OF THE PREFERRED EMBODIMENT

Figure 1:
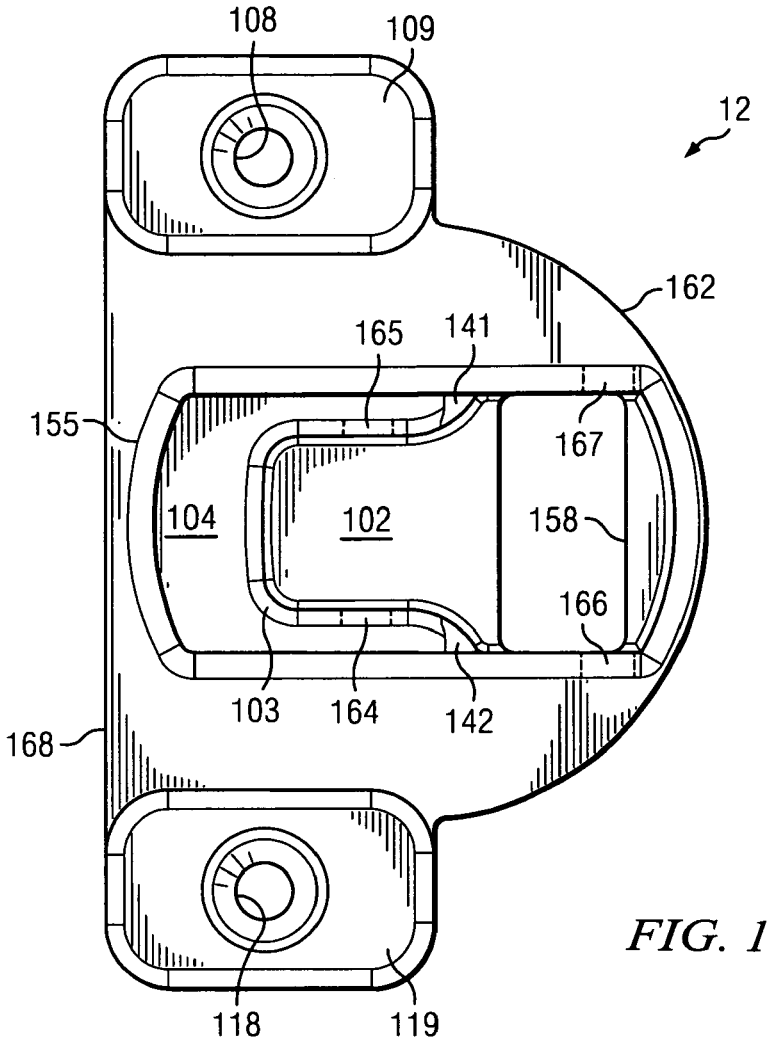
FIG. 1 is a plan view of a hinge cup of a preferred embodiment of the present invention.

In the descriptions that follow, like parts are marked throughout the specification and drawings with the same numerals. The drawing figures are not necessarily drawn to scale and certain figures may be shown in exaggerated or generalized form in the interest of clarity and conciseness. Copyright protection is claimed to the extent that protection is provided by copyright law.

Figure 2:
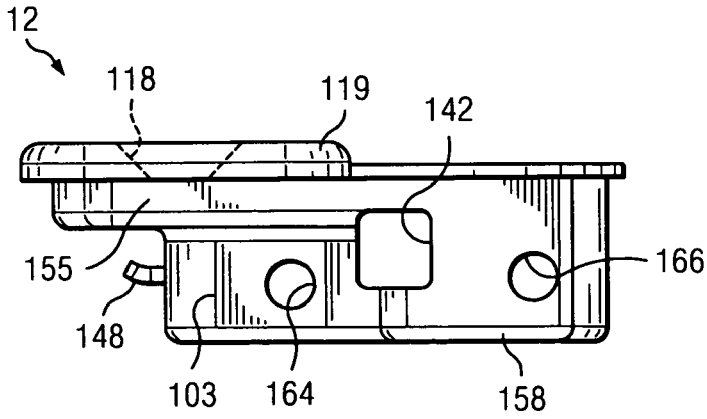
FIG. 2 is an elevation view of a hinge cup of a preferred embodiment of the present invention.

Hinge cup 12 is shown in FIGS. 1 and 2. Hinge cup 12 has a semicircular shaped brim 162 opposite ledge 168 encompassing a generally rectangular shaped indention or cup. Ledge 168 connects support 109 and support 119. Support 109 defines a circular support hole 108 and support 119 defines a circular support hole 118. The indention or cup of hinge cup 12 includes two different horizontal surfaces, cup floor 102 and cup shelf 104. Cup floor 102 forms the base of the cup shape and includes a generally rectangular shaped aperture floor hole 158. Cup shelf 104 is generally a "horseshoe shaped" horizontal surface located approximately halfway between cup floor 102 and ledge 168. Between cup floor 102 and cup shelf 104 is a generally semicircular shaped cup floor wall 103. Between ledge 168 and cup shelf 104 is a generally semicircular shaped cup shelf wall 155. At the tips of the horseshoe shape of cup shelf 104 are spring holes 141 and 142. Spring holes 141 and 142 are generally rectangular shaped apertures in cup shelf wall 155. Additionally, spring hub arm hole 164 and spring hub arm hole 165 are located in cup floor wall 103. Arm hub hole 166 and arm hub hole 167 are located in cup shelf wall 155. Spring hub arm hole 164 is the same diameter as and is concentrically aligned with spring hub arm hole 165 and is located on the opposite side of hinge cup 12. Further, arm hub hole 166 is the same diameter as and is concentrically aligned with arm hub hole 167. Tab 148 is a small projection located on cup floor wall 103 underneath cup shelf 104.

Figure 3:
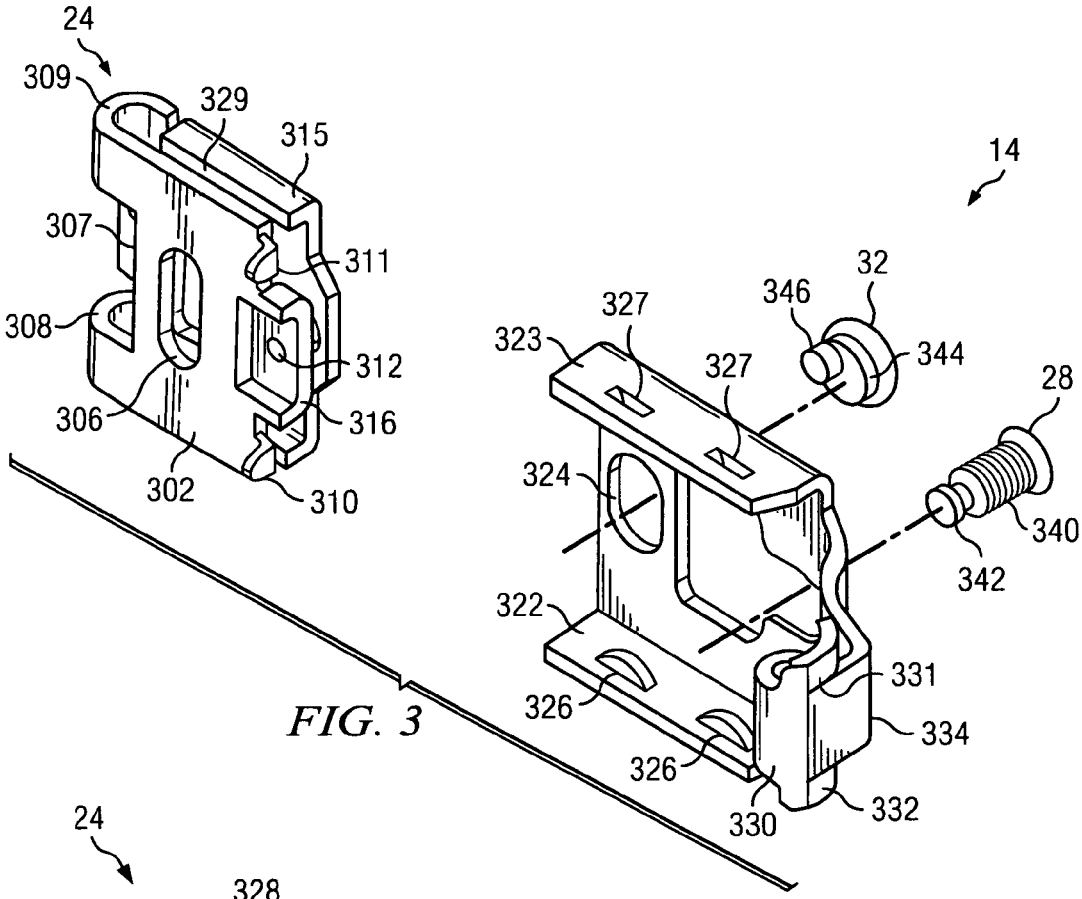
FIG. 3 is an exploded underside isometric view of a preferred embodiment of a hinge arm assembly of the present invention.
Figure 4:
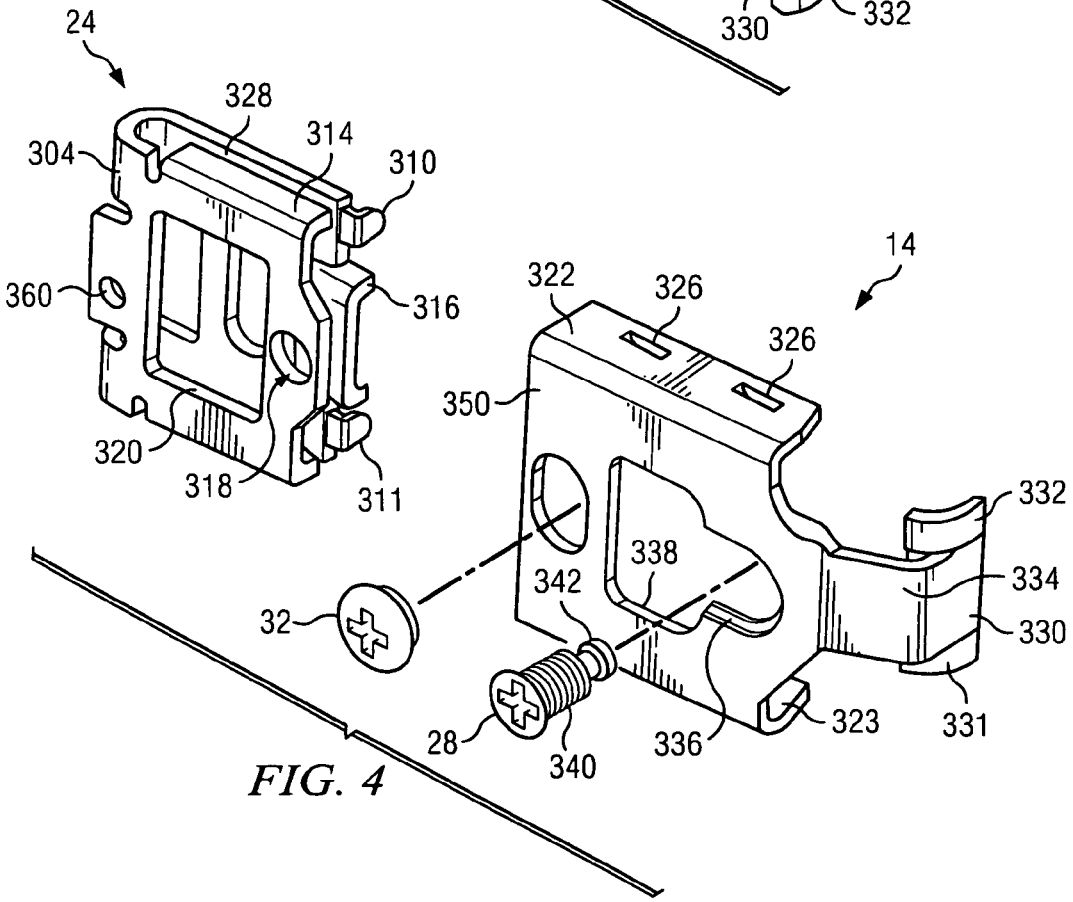
FIG. 4 is an exploded isometric view of a preferred embodiment of a hinge arm assembly of the present invention.

FIGS. 3 and 4 show fastener plate 24 and hinge arm 14. Additionally, eccentric cam 32 and adjustment screw 28 are shown. Fastener plate 24 includes fastener plate bottom 302 and fastener plate top 304. Fastener plate bottom 302 is connected to fastener plate top 304 by generally semicircular shaped hinge sections 308 and 309. Hinge sections 308 and 309 are generally semi-circular shaped deformable plates with an approximate interior radius of 0.75 millimeters. Hinge sections 308 and 309 are divided by hinge section gap 307. Fastener plate top 304 is generally parallel to fastener plate bottom 302 and is separated at one end by the interior diameter of hinges sections 308 and 309. Fastener plate bottom 302 includes an elongated aperture fastener plate mounting hole 306. In the preferred embodiment, fastener plate mounting hole 306 is approximately thirteen millimeters in length and approximately five millimeters wide. Also included on fastener plate bottom 302 extending at approximate right angles away from fastener plate top 304 are guides 310 and 311. Seat 316 is a generally rectangular shaped protrusion extending from fastener plate bottom 302 towards fastener plate top 304. In the approximate center of seat 316 is a circular shaped aperture adjustment screw mounting hole 312. Situated approximately perpendicular to and along the lateral edges of fastener plate top 304 are fastener plate sidewalls 314 and 315. Fastener plate sidewall 314 and fastener plate sidewall 315 are generally parallel to each other and extend from fastener plate top 304 towards fastener plate bottom 302 but do not come in contact with fastener plate bottom 302. The slotted spaces left between fastener plate sidewalls 314 and 315 and fastener plate bottom 302 are shown as slots 328 and 329 respectively. Fastener plate top 304 further includes a generally rectangular shaped aperture fastener plate access hole 320, circular and threaded hole 318, and a circular shaped fastener plate eccentric cam hole 360. In the preferred embodiment, the major axis of fastener plate access hole 320 is approximately thirteen millimeters and the minor axis is approximately ten millimeters in length.

Eccentric cam 32 includes eccentric cam face 344 and eccentric cam base 346, a circular shaft located to one side of the axial center of eccentric cam 32. Adjustment screw 28 includes a threaded section adjustment screw thread 340 and an end section adjustment screw base 342.

At one end of hinge arm 14 is arm hook 330. Arm hook 330 separates a pair of projections, cam surface 331 and cam surface 332. Arm hook 330 leads to arm section 334 that is connected to hinge arm top 350. Situated approximately perpendicular to and along the lateral edges of hinge arm top 350 are hinge arm sidewalls 322 and 323. Hinge arm sidewall 322 and hinge arm sidewall 323 lie in generally parallel planes. Hinge arm sidewall 322 includes an inward facing set of flanges 326. Similarly, hinge arm sidewall 323 includes a set of inward facing of flanges 327. The height of flanges 326 and 327 is generally equal to slots 328 and 329 and in the preferred embodiment are approximately 1.5 millimeters. Hinge arm top 350 further includes an elongated aperture hinge arm eccentric cam hole 324, a generally rectangular shaped hinge arm hole 338, having a section forming a generally semicircular shaped adjustment screw access hole 336.

Figure 5:
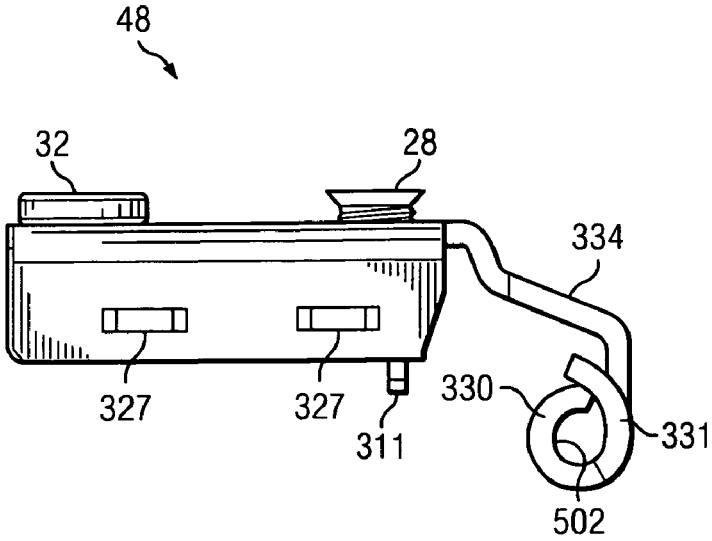
FIG. 5 is an elevation view of a preferred embodiment of a hinge arm assembly of the present invention.
Figure 6:
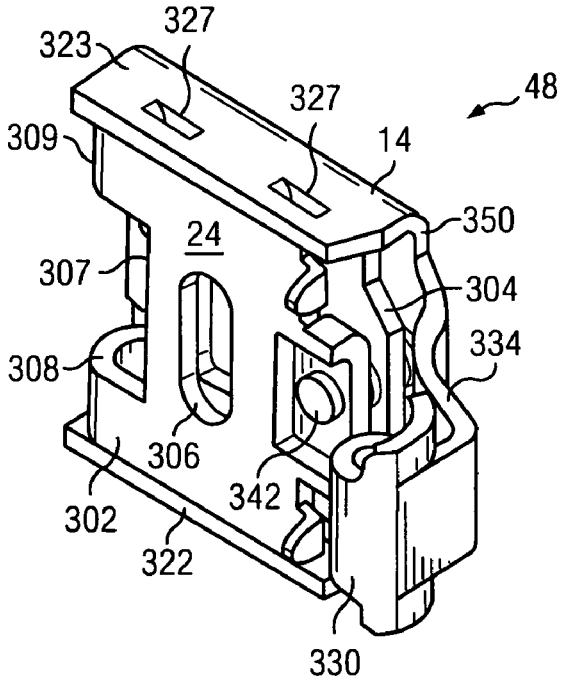
FIG. 6 is an underside isometric view of a preferred embodiment of a hinge arm assembly of the present invention.

FIGS. 5 and 6 depict hinge arm assembly 48. Hinge arm assembly 48 shows fastener plate 24 fitted with hinge arm 14 including eccentric cam 32 and adjustment screw 28. Arm hook 330 forms a hollow tubular shape defining pivot hole 502. Hinge arm 14 slidably engages fastener plate 24. Flanges 326 of hinge arm top 350 align with and slide into slot 328 between fastener plate sidewall 314 and fastener plate bottom 302. Simultaneously, flanges 327 of hinge arm top 350 align with and slide into slot 329 between fastener plate sidewall 315 and fastener plate bottom 302. In this position, fastener plate 24 is frictionally held by flanges 326 and 327 between fastener plate sidewalls 314 and 315 and fastener plate bottom 302 respectively. Except for eccentric cam 32, fastener plate 24 can slide lateral of hinge arm top 350. Eccentric cam 32 fits through hinge arm eccentric cam hole 324 and fastener plate eccentric cam hole 360. Eccentric cam base 346 is peened over once hinge arm assembly 48 is together, thus keeping fastener plate 24 and hinge arm 14 slidably engaged but allowing eccentric cam 32 to rotate in this position when turned. Similarly, adjustment screw 28 fits through adjustment screw access hole 336, threaded hole 318, and adjustment screw mounting hole 312. Adjustment screw 28 is also penned over once hinge arm assembly 48 is together forming adjustment screw base 342 thus preventing adjustment screw 28 from backing out of adjustment screw mounting hole 312.

Figure 10:
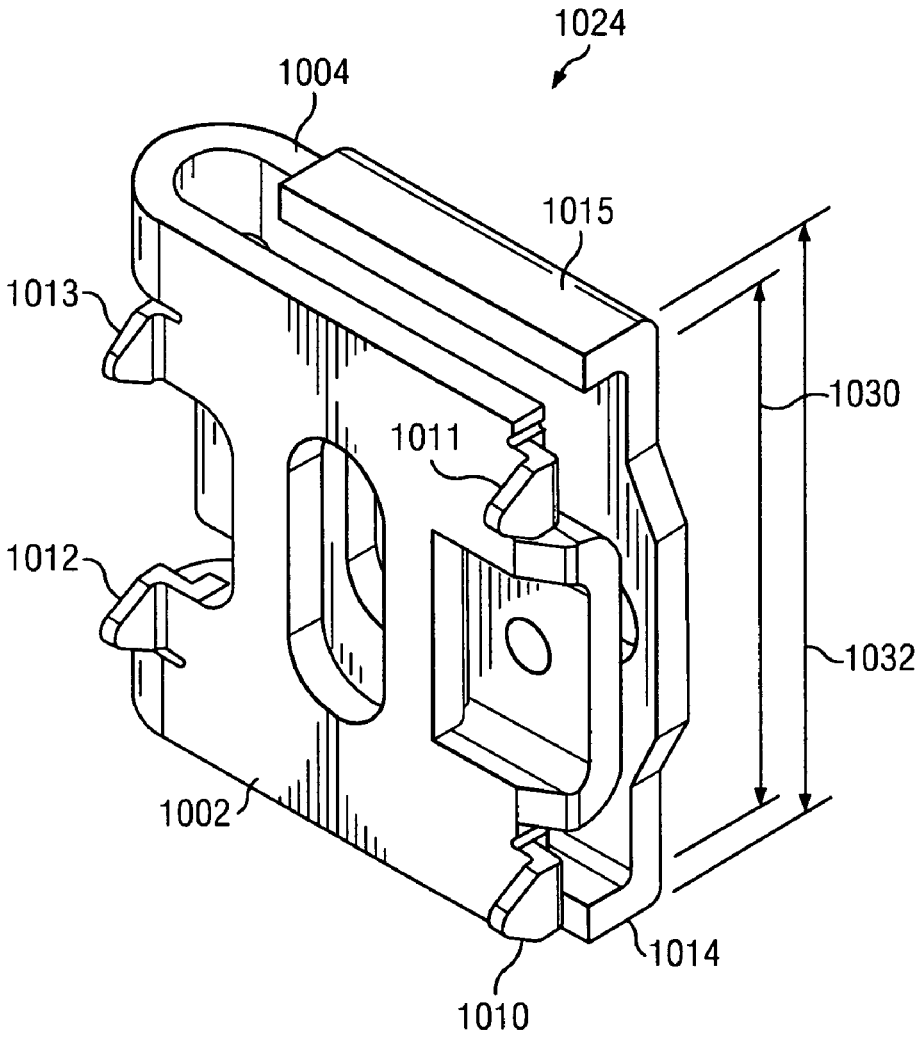
FIG. 10 is an underside isometric view of an alternate embodiment of a fastener plate of the present invention.

FIG. 10 shows an alternate preferred embodiment of fastener plate 1024. The overall width of fastener plate top 1004 shown as 1032 is greater than the width of fastener plate bottom 1002 shown as 1030. The wider top section results in sidewalls 1014 and 1015 not being positioned directly over fastener plate bottom 1002. Fastener plate 1024 is frictionally held to and slidably engaged with hinge arm 14 by the upper horizontal surfaces of flanges 326 and 327 abutting sidewalls 1014 and 1015 respectively while the top surface of fastener plate top 1004 becomes adjacent to hinge arm 14. Additionally, fastener plate 1024 includes guides 1010, 1011, 1012, and 1013. Guides 1012 and 1013 are positioned to be offset from and inside guides 1010 and 1011. The alternate embodiment allows the fastener plate bottom to advance upward and between flanges 326.

Figure 7:
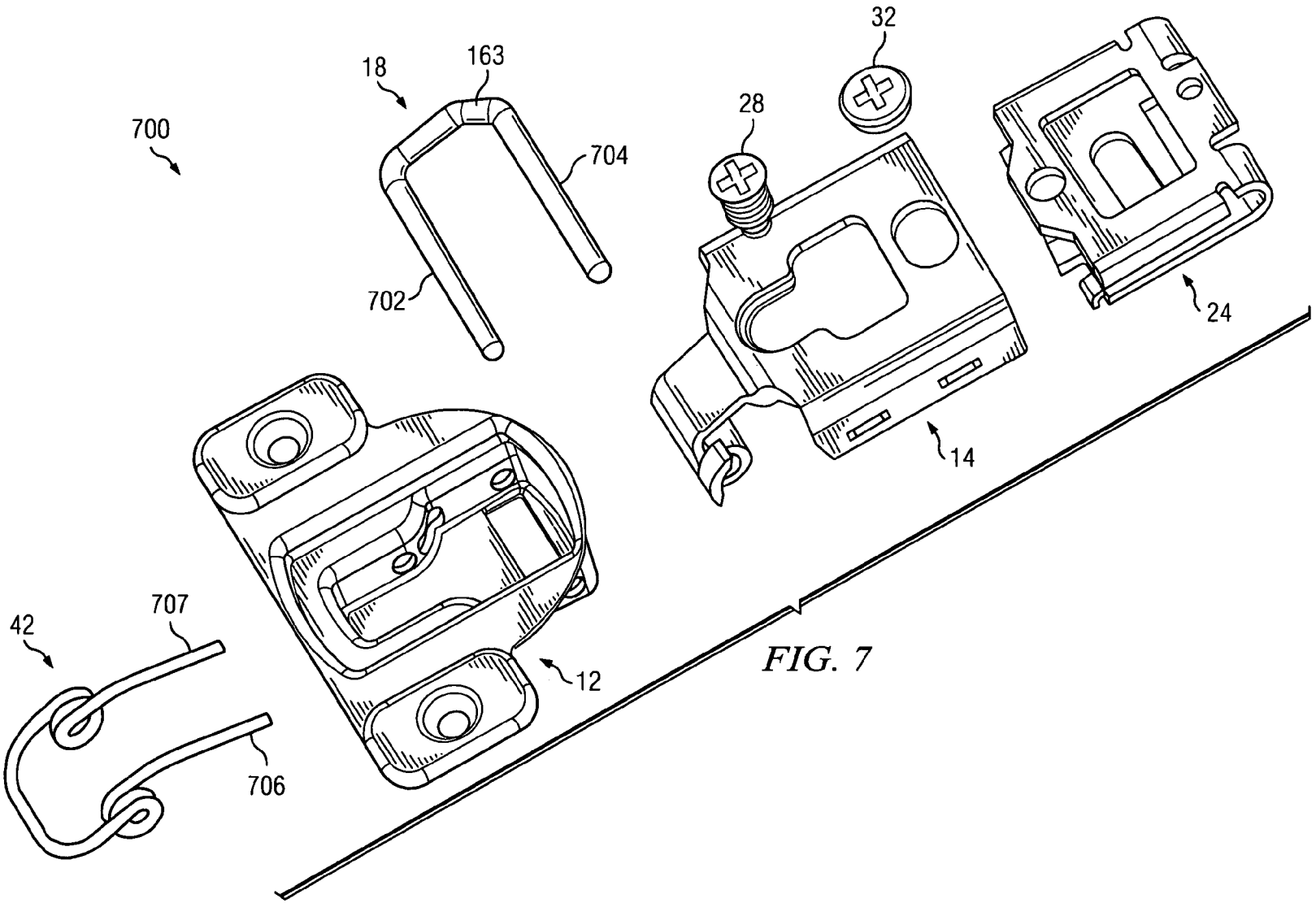
FIG. 7 is an exploded isometric view of a preferred embodiment of the present invention.

Referring to FIG. 7 the components comprising a preferred embodiment of the compact three dimensionally adjustable hinge 700 are shown in an exploded view. The compact adjustable hinge 700 serves to pivotally connect a piece of furniture to a door. When assembled, the compact adjustable hinge 700 generally includes coil spring 42, hinge cup 12, hinge pin 18, hinge arm 14, and fastener plate 24.

Hinge pin 18 is a solid shaft formed into a generally three sided rectangular shape. Hinge pin 18 is shaped to accommodate the semicircular shape of brim 162 through the inclusion of angled corner 163. In the preferred embodiment, the diameter of hinge pin 18 is approximately three millimeters. Hinge pin 18 includes spring hub arm 702 and arm hub 704. Arm hub 704 provides an axle for pivotally connecting hinge arm 14 to hinge cup 12. Spring hub arm 702 provides an axle for pivotally supporting coil spring 42 with respect to hinge cup 12. Spring hub arm 702 and arm hub 704 simultaneously fit through and are seated in spring hub arm holes 164 and 165 and arm hub holes 166 and 167 respectively. Those skilled in the art will recognize that spring hub arm 702 and arm hub 704 can be replaced by separate keeper pins or cotter keys.

Figure 8:
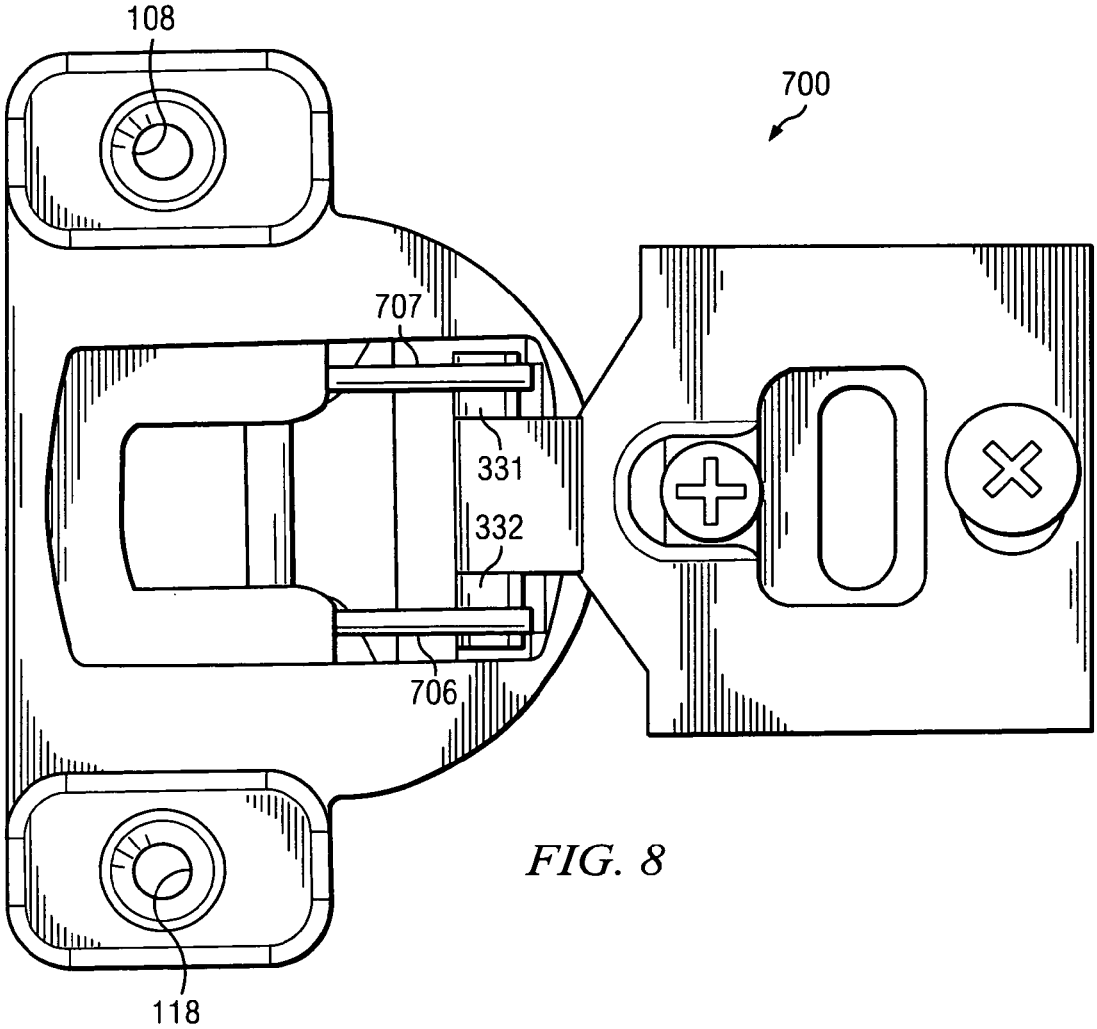
FIG. 8 is a plan view of a preferred embodiment of the present invention in assembled form.
Figure 9:
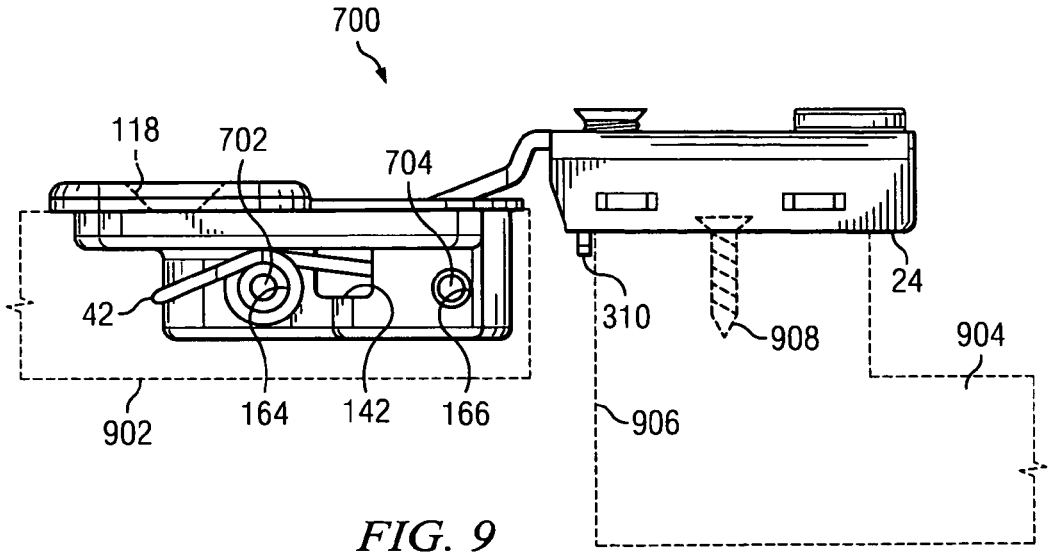
FIG. 9 is an elevation view of a preferred embodiment of the present invention in assembled form.

Referring to FIGS. 7, 8, and 9, it can be seen that coil spring 42 is positioned around the exterior of cup floor wall 103 and rests on tab 148. Coil spring 42 follows the exterior of hinge cup 12 to where spring hub arm 702 extends out of hinge cup 12 on both sides. Coil spring 42 is positioned around spring hub arm 702 and extends into the interior of hinge cup 12 through both spring holes 141 and 142. Coil spring ends 706 and 707 of coil spring 42 rest slidingly on cam surfaces 331 and 332 of hinge arm 14.

FIG. 9 shows compact adjustable hinge 700 installed to pivotally connect door member 902 with cabinet member frame 904. Typical installation requires that hinge cup 12 be fitted into a routed bore opening in the door of the cabinet and secured with wood screws or press fit dowels in support holes 108 and 118. Ledge 168 and brim 162 abut the inside surface of door member 902. Fastener plate 24 is mounted adjacent to cabinet member frame 904 using wood screw 908 passing through fastener plate mounting hole 306. Guides 310 and 311 in contact with one corner of the cabinet frame to ensure that fastener plate 24 is squarely aligned with cabinet member face 906 by slightly protruding around the corner of cabinet member face 906 and the inside door opening of cabinet member frame 904. In an alternate preferred embodiment, guides 1010, 1011, 1012 and 1013 perform the same function. Hinge arm assembly 48 is attached to hinge cup 12 at hinge pin 18. This attachment allows hinge arm 14 to rotate around hinge pin 18 and to move hinge arm 14 from a closed position to an open position.

The self-closing function of compact adjustable hinge 700 is accomplished by coil spring 42 biasing the hinge in either an open or a closed position. As hinge arm 14 pivots, coil spring ends 706 and 707 of coil spring 42 move over cam surfaces 332 and 331 respectively forcing compact adjustable hinge 700 to tend to rest on one side or the other of the cam surfaces in either the fully open position or the fully closed position.

Compact adjustable hinge 700 is constructed such that its overall longitudinal length is minimized. In a preferred embodiment, hinge cup 12 and hinge arm 14 each have a longitudinal length of approximately 34 to 36 millimeters and an overall length of approximately 65 to 68 millimeters when assembled. However, other lengths are acceptable as well within the scope of the invention. It is of course to be understood that the present invention is not limited to the identified connecting components and that other connecting components may be used. For example, it is known in the art to use a four bar linkage system comprised of multiple hinge arm elements connected to the fastener plate. The fastener plate and hinge arm can be adapted to this configuration.

In the preferred embodiment, hinge cup 12, fastener plate 24, and hinge arm 14 are typically constructed of metal such as cast aluminum or steel alloy plate stock and formed from casting or stamping but can also be made of injection molded plastic or nylon. In the preferred embodiment, the material used to construct hinge cup 12 is approximately 0.8 millimeters thick and the material used to construct fastener plate 24 and hinge arm 14 is approximately 1.5 millimeters thick.

In operation, hinge arm assembly 48 provides three dimensional adjustability for hinge 700. Having multiple adjustment capabilities contributes to proper closure of the door member thereby prolonging cabinet and hinge useful life. One direction of adjustment is the vertical movement of door member 902. This adjustment is required when the top and bottom edges of door member 902 do not align with the top and bottom edges of cabinet member frame 904 or an adjacent door member. Hinge arm assembly 48 is attached to the cabinet member frame 904 with wood screw 908 through fastener plate mounting hole 306. The elongated shape of fastener plate mounting hole 306 allows for vertical adjustments of the door member with respect to the cabinet frame. Door member 902 may be vertically adjusted to the proper height of an adjacent door member or adjoining cabinet member by loosening wood screw 908 and repositioning door member 902 to the desired height and retightening the wood screw. Fastener plate access hole 320 in fastener plate top 304 is positioned to permit access to the screw regardless of the screw's location in fastener plate mounting hole 306. For additional connection strength, additional wood screws may be used in the mounting hole to attach fastener plate 24 to the cabinet frame.

Another direction of adjustment is the horizontal movement of door member 902. This adjustment is required when the inside face of door member 902 does not lay flush with cabinet member face 906 impeding the opening and closing action. Eccentric cam 32, when turned, causes eccentric cam face 344 to engage the edge of hinge arm eccentric cam hole 324 in hinge arm top 350. Eccentric cam base 346 is engaged with fastener plate eccentric cam hole 360 of fastener plate top 304. The force of eccentric cam face 344 on hinge arm eccentric cam hole 324 converts the rotational movement into a horizontal movement resulting in the horizontal adjustment as between the door member and the cabinet frame member. As eccentric cam 32 is turned, hinge arm 14 slides horizontally with respect to fastener plate 24 resulting in door member 902 traveling horizontally with respect to cabinet member frame 904. In the preferred embodiment, a quarter turn of eccentric cam 32 translates into approximately three millimeters of horizontal travel.

A further direction of adjustment is the lateral movement of door member 902. This adjustment is also referred to as an overlay adjustment. This adjustment is required when the vertical edges of door member 902 do not align with the vertical edges of cabinet member frame 904 or the vertical edges of an adjacent door member. In most applications, more than one hinge 700 is used to mount a door member. Providing different lateral adjustments on two different hinges provides an angular adjustment to the cabinet door with respect to the cabinet member frame.

The lateral adjustment is achieved through the use of adjusting screw 28 which has adjustment screw thread 340 threadably engaged with threaded hole 318 and with adjustment screw base 342 rotatably affixed to adjustment screw mounting hole 312. Adjustment screw base 342 is expanded in order to retain it to fastener plate 24. Turning adjustment screw 28 clockwise advances it through threaded hole 318 and causes the screw to abut seat 316. Adjustment screw base 342 freely rotates in and is guided by adjustment screw mounting hole 312. Further clockwise rotation of adjustment screw 28 results in fastener plate top 304 rotating about the longitudinal axis of hinge sections 308 and 309 with respect to fastener plate bottom 302 by bending the hinge sections. Clockwise rotation of adjustment screw 28 increases the distance between fastener plate top 304 and fastener plate bottom 302 at the location of the adjustment screw, while counter-clockwise rotation decreases the distance. As the distance between the two fastener plates increases or decreases, by virtue of the fastener plates being attached to the cabinet member frame and hinge arm 14, a lateral movement of the door member with respect to the cabinet member frame is achieved.

Further, those skilled in the art will realize that the invention provides a stable long term adjustment because the hinge sections 308 and 309 are semi-permanently deformed by advancement of adjustment screw 28 and will hold an adjustment virtually indefinitely thereby eliminating the need for periodic readjustment. The elimination of a sufficient amount of material represented by gap 307, allows hinge sections 308 and 309 to be elastically bendable about a longitudinal axis parallel to the rotational axis of the hinge pin 18. The amount of space represented by gap 307 controls the amount of elasticity and the effort needed to impart the bending of the hinge sections. In the preferred embodiment, gap 307 is approximately sixteen millimeters.

It should be noted that the installation orientation with hinge cup 12 fitted into a bore opening on the door of a cabinet and the hinge arm assembly fitted on to the frame of a cabinet, could be reversed even though this is not the usual practice. In addition, the self closing compact adjustable hinge of the present invention may be used in other applications that require a hinge treatment, including furniture, overhead flipper doors mounted on shelves, and the like.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. An overlay adjustable hinge fixture for mounting a door member on a cabinet frame member comprising:

a hinge cup fitted for insertion into the door member, where the hinge cup has a spring support tab, a first pair of concentrically aligned support holes and a second pair of concentrically aligned support holes;

a hinge arm having a tubular slot pivotally connected to the hinge cup by a first axel pin through the tubular slot and the first pair of concentrically aligned support holes;

the hinge arm further comprising a face plate having a first access aperture and an elongated adjustment hole;

the faceplate further supporting an opposing set of guide flanges;

a deformable fastener plate comprised of a fastener plate top and a fastener plate bottom integrally connected by a set of deformable rigid connection plates;

the fastener plate top slidingly constrained by the set of guide flanges;

a spring functionally held adjacent the hinge cup by a second axel pin through the second pair of concentrically aligned support holes;

the tubular slot further forming at least one cam surface adjacent the spring whereby the spring biases the hinge arm against the hinge cup in at least one of an open position and a closed position;

wherein the fastener plate bottom includes an elongated aperture longitudinally aligned with the first axle pin;

a vertical adjustment screw for threaded insertion into the cabinet frame through the elongated aperture;

a first and a second set of alignment tabs, connected to the fastener plate bottom for alignment of the fastener plate bottom with the cabinet frame;

the fastener plate bottom further comprising a raised seat defining a centering hole;

wherein the fastener plate top is further comprised of a second access aperture adjacent the elongated aperture and an adjustment hole;

wherein the fastener plate top further comprise an offset cam connection;

a cam member rotatably mounted in the elongated adjustment hole and pivotally mounted in the offset cam connection;

an overlay adjustment screw for threaded insertion through the adjustment hole and abutting the centering hole;

wherein the overlay adjustment screw may be accessed through the first access aperture and rotated to move the fastener plate bottom with respect to the fastener plate top by bending the deformable rigid connection plate;

wherein the vertical adjustment screw may be accessed through the first access aperture and the second access aperture and rotated to allow movement of the abutment section with respect to the cabinet frame member; and wherein the cam member may be rotated to move the fastener plate top linearly with respect to the attachment section.

2. The adjustable hinge fixture of claim 1, wherein the second access aperture is located generally in the center of the fastener plate top and is coaxially aligned with the first access aperture and the elongated aperture.

3. The hinge of claim 1 wherein the set of flanges further comprises a pair of guide rails on the faceplate having a plurality of constraining indentions.

4. An adjustable hinge for mounting a door member on a cabinet frame member comprising:

a hinge cup pivotally connected to a hinge arm;

the hinge arm including a face plate having a first access aperture and a lateral adjustment cam in an oblong adjustment hole;

the lateral adjustment cam further comprising an offset cam stanchion in sliding contact with the oblong adjustment hole;

a horizontal adjustment member comprised of a unitarily formed first plate and second plate;

the first plate further comprising a second access aperture and an overlay adjustment screw in a threaded adjustment hole;

the first plate slidingly mounted in the face plate by a set of flanges with the first access aperture adjacent the second access aperture;

the first plate connected to the second plate by a deformable hinge plate; wherein the second plate further comprises an elongated hole generally aligned with the first access aperture and the second access aperture and including a receiving surface adjacent the overlay adjustment screw;

a first and a second set of alignment tabs connected to the unitarily formed second plate for alignment of the second plate with the cabinet frame;

wherein the overlay adjustment screw abuts the receiving surface; where the overlay adjustment screw advances when rotated thereby altering the location of the first plate relative to the second plate by bending the deformable hinge plate;

wherein the elongated hole is accessed for vertical adjustment of the hinge through the first access aperture and the second access aperture; and, wherein the first plate moves laterally with respect to the face plate when the lateral adjustment cam is rotated.

5. The adjustable hinge of claim 4, where the overlay adjustment screw further comprises an overlay adjustment screw attachment means, adjacent the receiving surface for retracting the first plate relative to the second plate by bending the deformable hinge plate when the overlay adjustment screw is turned.

6. An adjustable hinge for mounting a cabinet door having a receiving bore to a cabinet frame comprising:

a hinge cup held in the receiving bore by a set of mounting dowels;

a pair of mounting flanges attached to the hinge cup for attaching the hinge cup to the cabinet door;

a spring retaining tab on the hinge cup;

a pair of coaxially aligned spring retaining holes in the hinge cup;

a pair of coaxially aligned hinge arm mounting holes in the hinge cup;

a hinge arm having a tubular mounting hole and further comprising a first cam surface and a second cam surface;

the hinge arm rotatably mounted in the hinge cup by an axle pin through the hinge arm mounting holes and the tubular mounting hole;

a coiled bias spring having a pair of helical coils and a first end and a second end adjacent the helical coils and a connecting arch between the helical coils;

the coiled bias spring further attached to the hinge cup whereby the connecting arch is adjacent the spring retaining tab, the pair of helical coils is coaxially aligned with the pair of hinge mounting holes and retained by a retaining pin through the retaining holes, and the first end is in sliding contact with the first cam surface and the second end is in sliding contact with the second cam surface;

whereby cooperation of the coiled bias spring and the first cam surface and the second cam surface bias the hinge arm in one of an open position and a closed position;

the hinge arm forming a flat attachment plate having a first access hole and a set of linear guide members;

an abutment plate assembly having an elongated cabinet frame mounting hole for adjustably attaching the abutment plate assembly to the cabinet frame and a first set of guide flanges for centering the abutment plate assembly on the cabinet frame;

the abutment plate assembly further comprising a second set of guide flanges and a threaded lateral adjustment means whereby when a threaded member is rotated, lateral adjustment of the hinge door with respect to the cabinet frame occurs;

a cam means, connected between the flat attachment plate and the abutment plate assembly, whereby when a cam member is rotated, an overlay adjustment of the cabinet door with respect to the cabinet frame occurs;

wherein the abutment plate assembly further comprises a rigidly deformable unitary hinge plate integrally connected to a connection plate having a second access hole whereby the second access hole is generally collinear with the first access hole and the elongated cabinet frame mounting hole;

a threaded adjustment means, mounted in the abutment plate assembly whereby when the threaded adjustment means is rotated the connection plate is angularly displaced with respect to the abutment plate assembly by plastic deformation of the rigidly deformable unitary hinge plate.

7. The adjustable hinge of claim 6 wherein the threaded lateral means further comprises a threaded screw rotatably attached to a seating means for advancement and retraction of the seating means when the threaded screw is rotated.

8. The adjustable hinge of claim 6 wherein the cam means further comprises:

a cylindrical cam member, seated in an oblong cam hole in the flat attachment plate;

an offset cam follower hole in the abutment plate assembly; and, a cam standoff eccentrically mounted adjacent a central axis of the cylindrical cam member and pivotally retained in the follower hole.

9. The adjustable hinge of claim 6 wherein the threaded lateral adjustment means is accessible through the first access hole.

10. The adjustable hinge of claim 7 wherein the seating means further comprises:

a raised seat platform on the connection plate having a seating hole therethrough; and, a retaining means adjacent the seating hole and rigidly attached to the threaded retaining screw.

11. A hinge assembly comprising:

a hinge cup having a set of mounting flanges;

a hinge arm assembly pivotally mounted in the hinge cup along a pivot axis;

the hinge arm assembly comprising a first plate member and a second plate member;

the first plate member integrally formed with the hinge arm;

the first plate member further comprising a pair of opposing linear guide rails generally perpendicular to the pivot axis;

the first plate member further comprising a first access hole between the pair of opposing linear guide rails;

the second plate member comprising a top plate and a bottom plate integrally connected with a deformable hinge plate;

the top plate member further comprising a second access hole;

the top plate further connected to the bottom plate by a set screw assembly opposite the deformable hinge plate;

the bottom plate includes a first and a second set of stabilizing protrusions integrally formed therewith and extending from the bottom plate, and wherein the first set of stabilizing protrusions are positioned to be offset from and inside the second set of stabilizing protrusions;

the set screw assembly comprising a set screw operationally configured in a threaded hole in the top plate and a constraining hole in the bottom plate such that when the set screw is advanced the deformable hinge is deformed;

the top plate linearly constrained to travel within the pair of opposing linear guide rails;

the top plate further connected to the first plate member by a cam assembly;

the cam assembly comprising a cam member rotatably constrained in a first oblong hole in the first plate member and pivotally constrained in an offset cam follower hole in the top plate member adjacent the deformable hinge plate;

the first oblong hole having a first longitudinal axis generally parallel to the pivot axis;

the bottom plate further comprising a second oblong hole coaxial with the first access hole and the second access hole; and, the second oblong hole further having a second longitudinal axis generally parallel to the pivot axis.

12. The hinge assembly of claim 11 wherein:

the hinge arm includes a set of cam surfaces; and, a spring bias means, attached to the hinge cup and adjacent the set of cam surfaces, for biasing the hinge arm in one of the group of an open position and a closed position.

13. The hinge assembly of claim 11 wherein the spring bias means is a coil spring.

14. The hinge assembly of claim 11 wherein the set screw is accessible through the first access hole.

15. The hinge assembly of claim 11 wherein the cam member is axially constrained within the offset cam follower hole.

16. The hinge assembly of claim 11 wherein the set screw is axially constrained within the constraining hole.

* * * * *